US008231196B2

(12) United States Patent
Lang

(10) Patent No.: US 8,231,196 B2
(45) Date of Patent: Jul. 31, 2012

(54) CONTINUOUS FEED DUPLEX PRINTER

(75) Inventor: Joseph Herman Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 12/705,350

(22) Filed: Feb. 12, 2010

(65) Prior Publication Data

US 2011/0199414 A1 Aug. 18, 2011

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/101, 102, 104
See application file for complete search history.

(56) References Cited

U.S. PATENT DOCUMENTS

| | | | | |
|---|---|---|---|---|
| 5,812,151 | A * | 9/1998 | Kishine et al. | 346/44 |
| 7,390,133 | B2 | 6/2008 | Hatayama | |
| 7,416,185 | B2 * | 8/2008 | Clark | 271/291 |
| 2002/0105571 | A1 | 8/2002 | Izawa et al. | |
| 2007/0172285 | A1 | 7/2007 | Izawa et al. | |

* cited by examiner

*Primary Examiner* — An Do
(74) *Attorney, Agent, or Firm* — Maginot, Moore & Beck, LLP

(57) ABSTRACT

A printing system performs full printhead assembly width duplex printing operations on both sides of a continuous web of print media. The printing system includes an entrance roller configured to receive a print media and to direct the print media in a first direction or a second direction, an intermediate roller configured to receive the print media after the entrance roller directs the print media in the first direction, and to direct the print media in a third direction substantially opposite to the first direction, and an exit roller. An inverter apparatus inverts the print media after the entrance roller directs the print media in the first direction and before the exit roller receives the print media.

16 Claims, 7 Drawing Sheets

CONTINUOUS FEED DUPLEX PRINTER

TECHNICAL FIELD

The process and device described below relate to imaging devices and, more particularly, to continuous feed inkjet imaging devices.

BACKGROUND

Drop on demand inkjet technology for producing printed images has been employed in products such as printers, multifunction products, plotters, and facsimile machines. Generally, an inkjet image is formed by selectively ejecting ink drops from a plurality of drop generators or inkjets, which are arranged in a printhead, onto an image receiving substrate. For example, the image receiving substrate may be moved relative the printhead and the inkjets may be controlled to emit ink drops at appropriate times. The timing of the inkjet activation is performed by a printhead controller, which generates firing signals that activate the inkjets to eject ink. The image receiving substrate may be an intermediate image member, such as a print drum or belt, or a print medium, such as paper. The ink ejected from the inkjets is liquid ink, such as aqueous, solvent, oil based, curable ink, or the like, which is stored in containers installed in the printer. Alternatively, the ink may be loaded in a solid or a gel form and delivered to a melting device, which heats the ink to generate liquid ink that is supplied to a printhead.

An inkjet printer is either a continuous feed inkjet printer or a cut sheet inkjet printer. Cut sheet inkjet printers form images on precut sheets of print medium, and are useful in many applications including home and office settings. Continuous feed inkjet printers form images on a continuous strip or web of print media, and are often used in applications requiring high speed and high volume printing. To prepare a continuous feed inkjet printer for printing, the continuous web is routed from a web supply along a web path through the printer. Once the continuous web reaches the end of the web path, and exits the printer, the continuous web is connected to a rewinder, which pulls the continuous web through the printer along the web path. The rewinder winds the continuous web around an output roller so that the image bearing continuous web may be transported to, for example, a finishing station in which the web may be cut or otherwise processed.

Some continuous feed inkjet printers form printed images on only a first side of the continuous web, a process referred to as a simplex printing operation. Simplex continuous feed inkjet printers have printhead assemblies with printheads that are configured to eject ink across a printing zone on the continuous web that is less than the width of the web. The printing zone is typically centered on the web with appropriate margins on each side of the printing zone. During a simplex printing operation, the continuous web makes only one pass through the printer. Specifically, the rewinder pulls the continuous web through the printer along the web path only once during a simplex printing operation.

With the addition of an external continuous web inverting system, some continuous feed inkjet printers may be configured to form printed images on a first and a second side of the continuous web. Printing images on the first and the second side of a continuous web is referred to as a duplex printing operation. In a duplex printing operation, the continuous web makes two passes through the printer, and is referred to as a half-width dual-pass duplex printing operation. In particular, the continuous web is routed from a web supply through the printer to receive ink on the first side. After the continuous web exits the printer, the continuous web is inverted by the inverting system and is then routed again through the printer to receive ink on the second side. As used herein, the term "inverted" refers to manipulation of the web to turn the web over and enable a non-printed side of the web to be presented to a printhead assembly for printing. The non-inverted and inverted portions of the continuous web are positioned on the web path as shown in the prior art printing system of FIG. 7. Specifically, FIG. 7 illustrates a top view of a roller 10 that guides the continuous web 14 along the web path in direction 16. Portion 18 of the continuous web 14 is in a non-inverted orientation as received by the printer from the web supply. Portion 22 of the continuous web 14 is in an inverted orientation as received by the printer from the inverting system. The inverted portion 22 and the non-inverted portion 18 are positioned adjacent to each other. In these printing systems, some of the printheads in a printhead assembly eject ink onto the non-inverted portion of the web and the remaining printheads in the same printhead assembly eject ink onto the inverted portion of the web. If such a printing system is operated in a simplex printing manner, then all of the printheads in the printhead assembly may be used to eject ink onto a web having a width that is slightly larger than the width of the printhead assembly. Thus, duplex printing cannot be performed on a web that is any wider than about one-half the width of the printhead assembly. Enabling duplex printing across the full width of a printhead assembly with continuous feed inkjet printers is desirable.

SUMMARY

A printing system has been developed that is capable of performing full printhead assembly width duplex printing operations on both sides of a continuous web of print media. The printing system includes an entrance roller mounted to a frame, the entrance roller being configured to receive a print media and to direct the print media in a first direction or a second direction, an intermediate roller mounted to the frame, the intermediate roller being configured to receive the print media after the entrance roller directs the print media in the first direction, and the intermediate roller being further configured to direct the print media in a third direction, the third direction being substantially opposite to the first direction, an exit roller mounted to the frame, the exit roller being configured to receive the print media after one of (i) the intermediate roller directs the print media in the third direction and (ii) the entrance roller directs the print media in the second direction, and an inverter apparatus mounted to the frame, the inverter apparatus being positioned to invert the print media after the entrance roller directs the print media in the first direction and before the exit roller receives the print media, the inverter apparatus including an input configured to receive the print media with a first surface of the print media facing toward a fourth direction and an output configured to expel the print media with the first surface facing toward a fifth direction, the fifth direction being substantially opposite to the fourth direction.

In another embodiment, a printing system has been developed that is capable of performing full printhead assembly width duplex printing operations on both sides of a continuous web of print media. The printing system includes a first printhead assembly mounted to a frame, the first printhead assembly being configured to eject ink onto a print media, a second printhead assembly mounted to the frame, the second printhead assembly being configured to eject ink onto the print media after the first printhead assembly ejects ink onto the print media, and a media conditioner assembly mounted to the frame, the media conditioner assembly being positioned to receive the print media selectively after the first printhead assembly ejects ink onto the print media, the media conditioner assembly being further configured to direct the print media to the second printhead assembly.

A method has been developed of performing full printhead assembly width duplex printing operations on a continuous web of print media. A method of printing on a print media includes receiving a print media with an entrance roller, the entrance roller being mounted to a frame, directing the print media in a first direction or a second direction with the entrance roller, receiving the print media with an intermediate roller after the entrance roller directs the print media in the first direction, the intermediate roller being mounted to the frame, directing the print media in a third direction with the intermediate roller after the intermediate roller receives the print media, the third direction being substantially opposite to the first direction, receiving the print media with an inverter apparatus mounted to the frame after the intermediate roller directs the print media in the third direction, the inverter apparatus including an input configured to receive the print media with a surface of the print media facing toward a fourth direction and an output configured to expel the print media with the surface facing toward a fifth direction, the fifth direction being substantially opposite to the fourth direction, receiving the print media with an exit roller after the inverter apparatus expels the print media, the exit roller being mounted to the frame, and receiving the print media with the exit roller after the entrance roller directs the print media in the second direction.

BRIEF DESCRIPTION OF THE FIGURES

The foregoing aspects and other features of the present disclosure are explained in the following description, taken in connection with the accompanying drawings.

DETAILED DESCRIPTION

The apparatus and method described herein make reference to a printing system. The term "printing system" refers, for example, to reproduction devices in general, such as printers, facsimile machines, copiers, and related multi-function products. While the specification focuses on an inkjet printing system, the apparatus and method described herein may be used with any printing system that forms an image on an image receiving surface, including, but not limited to, xerographic, laser, and aqueous printing systems.

Figure 1:
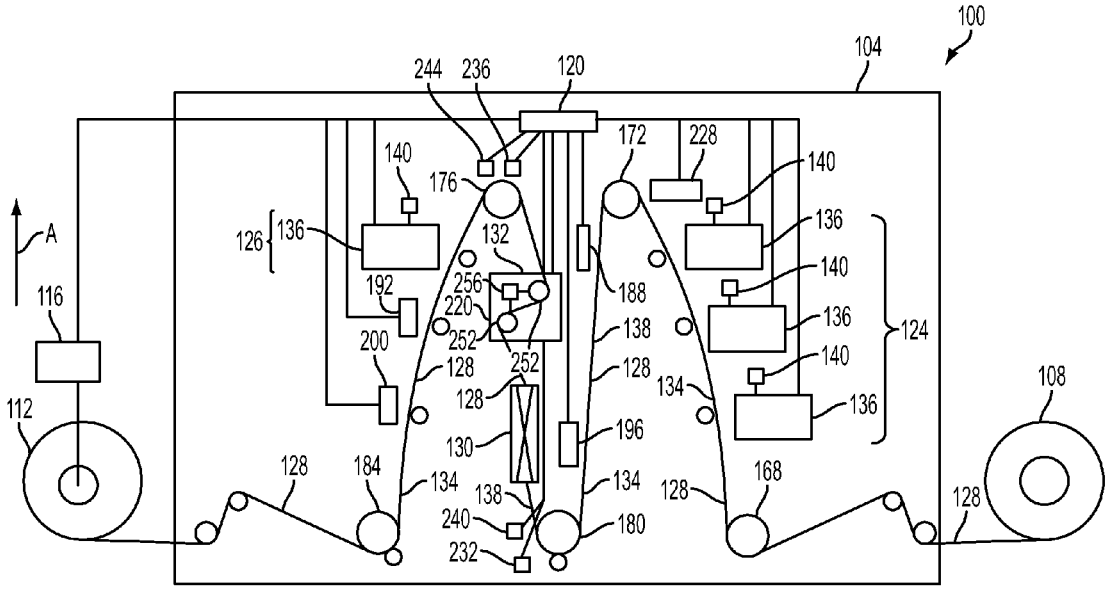
FIG. 1 is a block diagram of a continuous feed printing system as disclosed herein, the printing system being configured to perform duplex printing operations on a continuous web of print medium having a width equal to or less than a print width of the printing system.

As shown in FIG. 1, a continuous feed printing system 100 forms images on a continuous web of print medium. The printing system 100 is user configurable to perform simplex and duplex printing operations on a continuous web having a width limited only by the width of the web path and a print width of the printhead assemblies. For example, if the printing system 100 includes printhead assemblies having a print width of approximately fifty centimeters (50 cm), the printing system 100 may perform duplex printing operations on a continuous web having a width of up to approximately fifty centimeters (50 cm). The printing system 100 inverts the continuous web at an intermediary point of the web path to enable the continuous web to pass through the printing system 100 only once during duplex printing operations. Accordingly, the printing system 100 may be described as a full-width single-pass duplex printing system.

The printing system 100 of FIG. 1 includes a support frame 104, a web supply 108, a rewinder 112, an actuator 116, a printhead controller 120, first and second printhead assemblies 124, 126, a inversion device 130, and a registration device 132, among other components. The frame 104 is configured to support the components of the printing system 100, including, but not limited to, the printhead controller 120, the printhead assemblies 124, 126, the inversion device 130, and the registration device 132. The web supply 108 is a generally continuous length of print medium that may be wound upon a rotatably supported spool. The actuator 116 is coupled to the rewinder 112 to rotate the rewinder 112 and to draw a continuous web 128 of print medium from the web supply 108 through the printing system 100. The continuous web 128 moves past the printhead assemblies 124, 126 along a configurable web path 134. The controller 120 processes image data to generate a sequence of firing signals, which are sent to the printhead assemblies 124, 126. The firing signals cause the printheads in the printhead assemblies 124, 126 to eject ink onto the continuous web 128 in a pattern that forms an image on the continuous web 128 that corresponds to the image data.

The printhead assemblies 124, 126 include one or more printhead units 136 positioned to eject ink onto the continuous web 128. In particular, in response to the printing system 100 being configured for simplex printing operations, in which a printed image is formed on only a first side of the continuous web 128, each of the printhead units 136 ejects ink onto the first side of the continuous web 128. In response to the printing system 100 being configured for duplex printing operations, in which a printed image is formed on both the first and the second side of the continuous web 128, the printhead units 136 of the printing assembly 124 eject ink onto the first side of the continuous web 128 and the printhead units 136 of the printing assembly 126 eject ink on the second side of the continuous web 128.

The printhead units 136 of the printhead assemblies 124, 126 form printed images with one of numerous ink compositions. Exemplary ink compositions include, but are not limited to, phase change inks, gel based inks, curable inks, aqueous inks, and solvent inks. As used herein, the term "ink composition" encompasses all colors of a particular ink composition including, but not limited to, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink", also referred to as "solid ink", encompasses inks that remain in a solid phase at an ambient temperature and that melt to a liquid phase when heated above a threshold temperature, referred to in some instances as a melt temperature. The ambient temperature is the temperature of the air surrounding the printing system 100; however, the ambient temperature may deviate from a room temperature when the printing system 100 is positioned in an enclosed or otherwise defined space. The ambient temperature may fluctuate at various positions along the web path 134. An exemplary range of melt temperatures for phase change ink is approximately seventy degrees (70°) to one hundred forty degrees (140°) Celsius; however, the melt temperature of some phase change inks may be above or below the exemplary melt temperature range. When phase change ink cools below the melt temperature, the ink returns to the solid phase. The printhead units 136 eject phase change ink in the liquid phase onto the continuous web 128. The ink ejected onto to the continuous web 128 becomes affixed to the continuous web 128 in response to the ink cooling below the melt temperature.

The terms "gel ink" and "gel based ink", as used herein, encompass inks that remain in a gelatinous state at the ambient temperature and that may be heated or otherwise altered to have a different viscosity suitable for ejection onto the continuous web 128 by a printhead unit 136. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty degrees (30°) to fifty (50°) degrees Celsius; however, the gelation temperature of some gel inks may be above or below the exemplary gelation temperature range. The viscosity of gel ink increases when the ink cools below the gelation temperature. Some gel inks ejected onto the continuous web 128 become affixed to the continuous web 128 in response to the ink cooling below the gelation temperature.

Some ink compositions, referred to herein as curable inks, are cured by the printing system 100. As used herein, the process of "curing" ink refers to curable compounds in an ink undergoing an increase in molecular weight in response to being exposed to radiation. Exemplary processes for increasing the molecular weight of a curable compound include, but are not limited to, crosslinking and chain lengthening. Cured ink is suitable for document distribution, is resistant to smudging, and may be handled by a user. Radiation suitable to cure ink may encompass the full frequency (or wavelength) spectrum including, but not limited to, microwaves, infrared, visible, ultraviolet, and x-rays. In particular, ultraviolet-curable gel ink, referred to herein as UV gel ink, becomes cured after being exposed to ultraviolet radiation. As used herein, the term "ultraviolet" radiation encompasses radiation having a wavelength from approximately fifty nanometers (50 nm) to approximately five hundred nanometers (500 nm).

The printing system 100 includes ink sources 140 that contain a quantity of liquid ink for ejection onto the continuous web 128 by the printhead units 136. The term "liquid ink" as used herein, includes, but is not limited to, aqueous inks, liquid ink emulsions, pigmented inks, phase change inks having been heated to the liquid phase, and gel inks having been heated or otherwise treated to alter the viscosity of the ink for improved jetting. Additionally, the term "liquid ink" refers to ink that has been ejected onto the continuous web 128, but that has not yet been affixed to the continuous web 128 through a curing, cooling, or drying process, among other processes.

Figure 2:
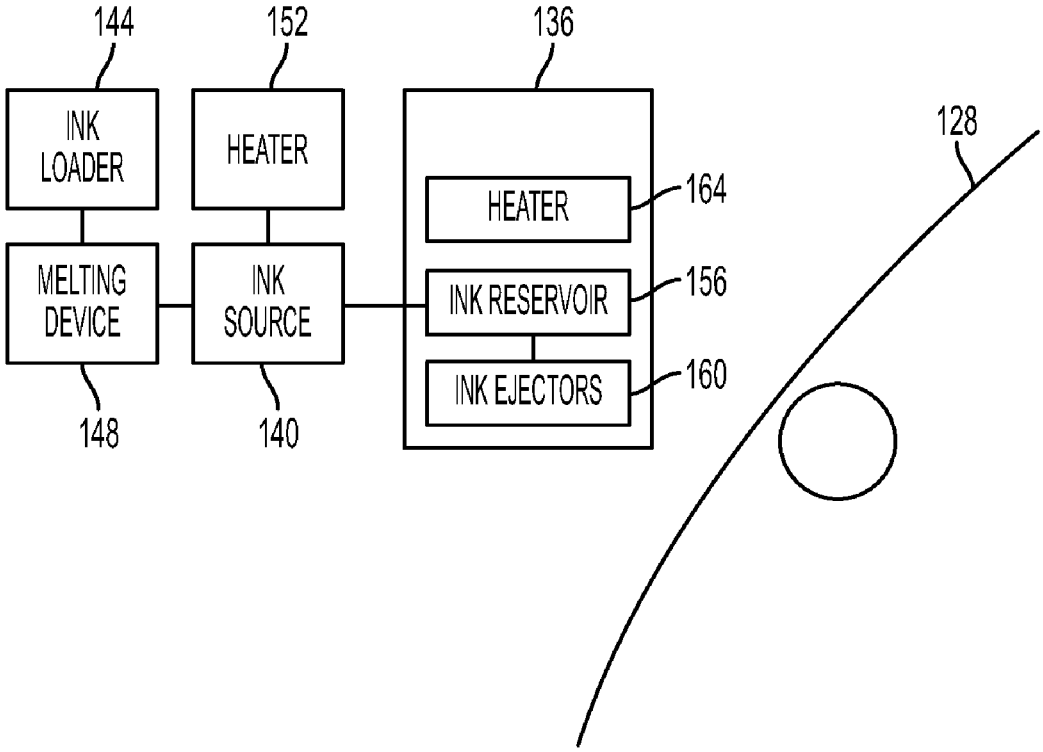
FIG. 2 is a block diagram illustrating a portion of the printing system of FIG. 1, the printing system including an ink loader and a melting device coupled to an ink source.

As shown in FIG. 2, the printing system 100 may include an ink loader 144, a melting device 148, and a heater 152 coupled to each ink source 140. When the printing system 100 is configured to form printed images with phase change ink, the ink loader 144 contains a quantity of phase change ink in the solid phase. Phase change ink is supplied to the ink loader 144 as solid ink pellets or solid ink sticks, among other forms. The ink loader 144 moves the phase change ink toward the melting device 148, which melts a portion of the ink into the liquid phase. The liquid ink is delivered to an ink source 140, which is thermally coupled to the heater 152. The heater 152 is configured to heat the ink source 140 to a temperature that maintains the phase change ink in the liquid phase. Liquid ink from the ink source 140 is delivered to a printhead unit 136. In particular, the ink is delivered to an ink reservoir 156 within the printhead unit 136. The ink reservoir 156 is fluidly coupled to a plurality of ink ejectors 160 configured to eject the liquid ink onto the continuous web 128. The ink ejectors 160 may be thermal ink ejectors and/or piezoelectric ink ejectors, among other types of ink ejectors, as is known in the art. The printhead unit 136 may also include a heater 164 for maintaining the ink contained by the ink reservoir 156 in the liquid phase.

The portion of the printing system 100 illustrated in FIG. 2 may also be configured to form printed images with gel ink. When the printing system 100 is configured to form images with gel ink, a quantity of gel ink may be loaded directly into the ink source 140. The gel ink may be loaded into the ink source 140 in either a gelatinous state or a state of reduced viscosity. Heater 152 heats the gel ink contained by the ink source 140 to maintain the gel ink at a liquid-like viscosity. The gel ink from the ink source 140 is transferred to the reservoir 156 for ejection by the ink ejectors 160. Heater 164 heats the reservoir 156 to maintain the liquid-like viscosity of the gel ink contained in the reservoir 156.

With reference again to FIG. 1, the printhead assembly 124 includes three printhead units 136, and the printhead assembly 126 includes one printhead unit 136. The number of printhead units 136 of each printhead assembly 124, 126 is dependent on the ink composition ejected by the printing system 100 and the number of ink colors required to print a desired image, among other factors. For example, if the printing system 100 is configured to print images with curable gel ink, the printhead assembly 126 may include only one printhead unit 136 to enable a curing device 192 and an ink leveler 200 to be positioned on the web path 134. If the printing system 100 is configured to print images with phase change ink, however, the printhead assembly 126 may include three (3) printhead units 136, as shown in FIG. 3.

Figure 4:
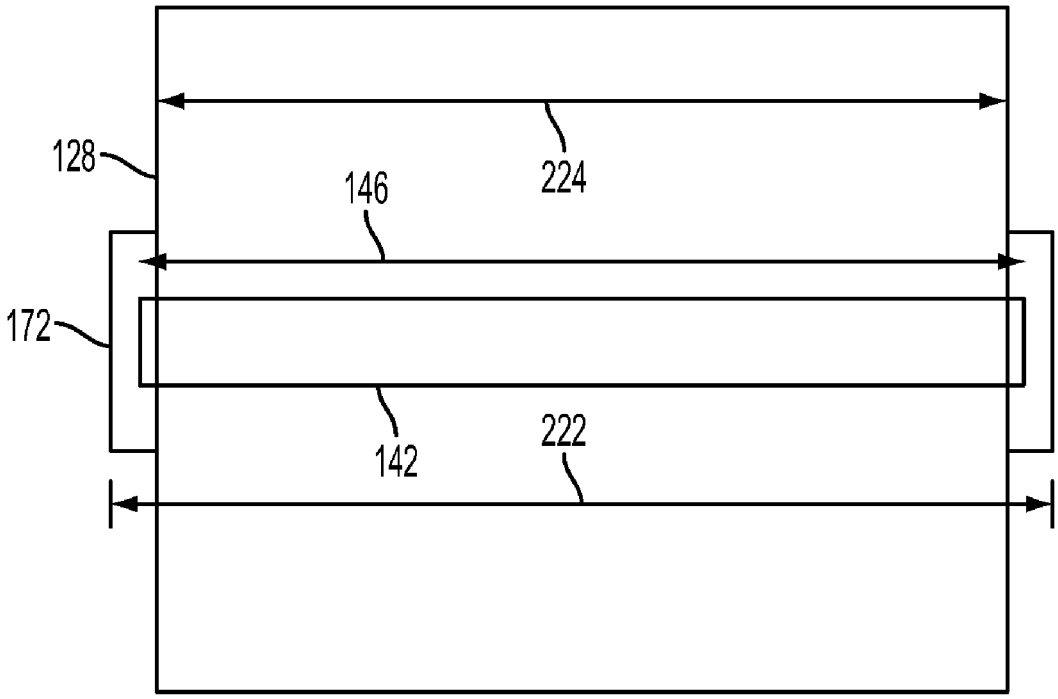
FIG. 4 is a top view of an idler roller configured to guide a "full width" continuous web through the printing system of FIG. 1.

As shown in FIG. 4, the inkjet ejectors 160 of each printhead unit 136 eject ink onto the continuous web 128 in print zone 142. The print zone 142 has a print width 146, which may extend beyond the continuous web 128 or may extend for a distance less than a width of the continuous web 128. When performing a duplex printing operation, the printing system 100 forms an image having a width less than or equal to the print width 146 on both sides of the continuous web 128 as the continuous web 128 makes a single pass through the printing system 100.

Figure 3:
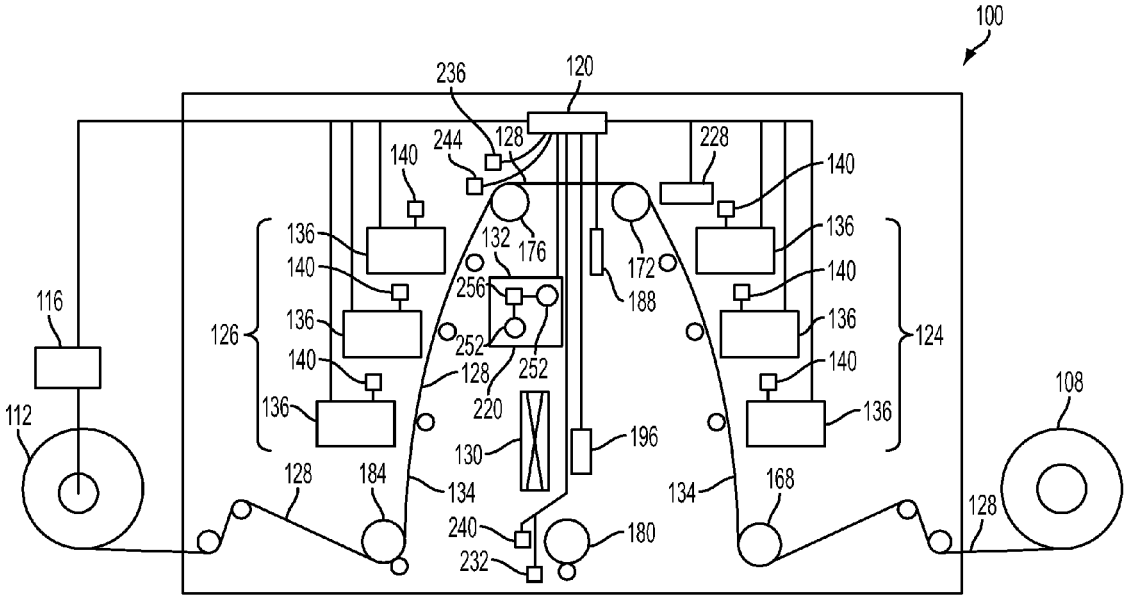
FIG. 3 is a block diagram of the printing system of FIG. 1 with the printing system being configured to perform simplex printing operations on a continuous web and including a second printing apparatus having three printhead units.

As shown in FIGS. 1 and 3, the printing system 100 includes idler rollers 168, 172, 176 and ink spreaders 180, 184 that define the configurable web path 134 for the continuous web 128. The idler rollers 168, 172, 176 are rotatably connected to the frame 104 to guide the continuous web 128 along directional changes of the web path 134. In the illustrated embodiments of the printing system 100, the idler rollers 168, 172, 176 and the ink spreaders 180, 184 may define either a generally "M" shaped web path 134, as shown in FIG. 1, or a generally "A" shaped web path, as shown in FIG. 3.

The generally "A" shaped web path 134 begins at the idler roller 168 and extends upward toward the idler roller 172, as shown in FIG. 3. The idler roller 168, which is configured to receive the continuous web 128, may be referred to as a guide roller. The idler roller 168 directs the continuous web 128 to the idler roller 172, which is configured to receive the continuous web 128. The idler roller 172 may be referred to as an entrance roller. The printhead assembly 124 ejects ink onto the continuous web 128 after the idler roller 168 directs the continuous web 128 and before the idler roller 172 receives the continuous web 128. Next, the idler roller 172 directs the continuous web 128 to the idler roller 176 in a direction that is approximately horizontal. The idler roller 176, which may be referred to as an exit roller, receives the continuous web 128 and then directs the continuous web 128 downward toward the ink spreader 184. The printhead assembly 126 ejects ink onto the continuous web 128 after the idler roller 176 directs the continuous web 128 and before the ink spreader 184 receives the continuous web 128.

The printing system 100 enables the web path 134 to be user configured to the generally "M" shaped web path 134 shown in FIG. 1. The "M" shaped web path 134 begins at the idler roller 168 and extends upward to the idler roller 172. Next, the idler roller 172 directs the continuous web 128 downward toward the ink spreader 180. The ink spreader 180 may be referred to as an intermediate roller. After the ink spreader 180 receives the continuous web 128, the ink spreader 180 directs the continuous web 128 upward toward the idler roller 176. Next, the "M" shaped web path 134 extends downward from the idler roller 176 to the ink spreader 184. The portion of the "M" shaped web path 134 extending from the idler roller 172 to the ink spreader 180 and then from the ink spreader 180 to the idler roller 176 is referred to herein as the notch portion 138 of the web path 134. As described below, printing elements may be connected to the notch portion 138, including, but not limited to, an inline inversion device 130, an ink curing device 188, and a non-contact leveling device 196, each of which are described below. In both the "M" shaped and "A" shaped web paths 134 the idler roller 176 directs the continuous web 128 to the ink spreader 184, which may be referred to as a guide roller.

Liquid ink ejected onto the continuous web 128 is not contacted by the idler rollers 168, 172, 176 before the ink is dried, cured, hardened, cooled or otherwise finished. In particular, the printhead assembly 124 ejects ink onto a first side of the continuous web 128 and the idler rollers 172, 176 contact a second side of the continuous web. The idler roller 168 contacts the continuous web 128 before the printhead assemblies 124, 126 eject ink onto the continuous web 128. Any liquid ink that has been ejected onto the first side of the continuous web 128 by a prior printing process has dried, cured, hardened, cooled or has otherwise been finished before the idler roller 168 contacts the first side of the continuous web 128.

The ink spreaders 180, 184 are pairs of rollers between which the continuous web 128 passes. Ink droplets ejected onto the continuous web 128 by the printhead units 136 are flattened into a substantially continuous area as the continuous web 128 is drawn therebetween. Although the ink spreaders 180, 184 remain coupled to the frame 104 regardless of the ink composition ejected by the printhead assemblies 124, 126, the ink spreaders 180, 184 are generally configured to spread only phase change ink. The ink spreaders 180, 184 are positioned to spread phase change ink before the ink cools to the solid phase. Solid ink that has been spread by the ink spreader 180 emerges from the ink spreader 180 in a set or finished state. In particular, solid ink that has been spread by the ink spreader 180 may be contacted by rollers within the inversion device 130 and rollers within the steering device 220 without smearing, smudging, or otherwise changing in appearance. Curable ink, such as UV gel ink, ejected by the printhead assembly 124 may be cured before contacting the ink spreader 180, and curable ink ejected by the printhead assembly 126 may be cured before contacting the ink spreader 184, such that the appearance of the cured ink is not altered by contact with the ink spreaders 180, 184. Additionally, in response to the printing system 100 being configured to form images with curable ink, the nip pressure exerted on the continuous web 128 by the ink spreaders 180, 184 may be reduced to lessen the spreading effect of the ink spreaders 180, 184. Similarly, the nip pressure may be further reduced by separating the rollers of each of the ink spreaders 180, 184. Reducing the nip pressure of the ink spreaders 180, 184 prevents the ink spreaders 180, 184 from altering the appearance of the cured ink ejected onto the continuous web 128.

The printing system 100 may include one or more leveling devices 188, 192 positioned to level ink droplets ejected onto the continuous web 128, as shown in FIG. 1. The leveling devices 188, 192 are configured to blend ink droplets, including, but not limited to, gel ink, into a substantially continuous area without contacting the ink droplets or the continuous web 128. In particular, the ink droplets ejected onto the continuous web 128 by the ink ejectors 160 are spaced apart from one another such that each ink droplet is separated from each other ink droplet by a region of the continuous web 128. The leveling devices 188, 192 close the gaps between adjacent ink droplets, such that a continuous region of ink is formed that covers completely a portion of the continuous web 128. The leveling devices 188, 192 may be thermal reflow devices configured to heat the ink ejected onto the continuous web 128 to a temperature, which blends together ink droplets. A thermal reflow device may emit infrared radiation to heat the ink ejected onto the continuous web 128. The ink ejected onto the continuous web 128 is exposed to the infrared radiation generated by the leveling devices 188, 192.

As shown in FIG. 1, a leveling device 188 may be positioned after the printhead assembly 124 to level the ink ejected by the printhead assembly 124 before the ink is contacted by the ink spreader 180. Similarly, a leveling device 192 may be positioned after the printhead assembly 126 to level the ink ejected by the printhead assembly 124 before the ink is contacted by the ink spreader 184. In some embodiments, the leveling devices 188, 192 may be coupled to the controller 120 to receive a leveler signal, which controls when the leveling devices 188, 192 are activated to level ink droplets.

The printing system 100 may also include one or more curing devices 196, 200 for curing the ink ejected by the printhead assemblies 124, 126. As described above, some ink compositions including, but not limited to, ultraviolet curable gel ink, are cured during the printing process. Therefore, embodiments of the printings system 100 configured to form images with curable ink, may include a curing device 196 positioned after the printhead assembly 124 and a curing device 200 positioned after the printhead assembly 126.

The curing devices 196, 200 emit radiation having a wavelength in a range that cures the curable ink. For instance, the curing devices 196, 200 may emit ultraviolet radiation. The curing devices 196, 200 are positioned after the leveling devices 188, 192 to cure the ink after the ink has been leveled by the leveling devices 188, 192 and before the ink is contacted by the ink spreaders 180, 184. In some embodiments, the curing devices 196, 200 may be electrically coupled to the controller 120 to receive a curing signal, which controls when the curing devices 196, 200 emit radiation.

The curing device 196 cures the ink ejected onto the continuous web 128 before the ink reaches the ink spreader 180, and the curing device 200 cures the ink ejected onto the continuous web 128 before the ink reaches the ink spreader 184. Therefore, even though the cured ink passes through the ink spreaders 180, 184 the cured ink is not spread by the ink spreaders 180, 184. Curing the ink with the curing devices 196 before the ink contacts the ink spreaders 180 enables the inversion device 130 and steering device 220 to contact the cured ink without smearing, smudging, or otherwise changing the appearance of the ink. Additionally, as described above, the nip pressure of each ink spreader 180, 184 may be reduced to prevent the ink spreaders 180, 184 from altering the appearance of the cured ink.

As shown in FIG. 1, the printing system 100 includes an inversion device 130 for inverting the continuous web 128 with respect to the printhead assemblies 124, 126. The inversion device 130 is positioned on the notch portion 138 of the web path 134 to invert the continuous web 128 after the continuous web 128 passes the printhead assembly 124 and before the continuous web 128 passes the printhead assembly 126. The inversion device 130 is positioned to invert the continuous web 128 after the idler roller 172 directs the continuous web 128 toward the ink spreader 180 and before the continuous web 128 is received by the idler roller 176. Accordingly, the inversion device 130 inverts the continuous web 128 as the continuous web 128 passes from the idler roller 172 to the ink spreader 184 or as the continuous web 128 passes from the ink spreader 180 to the idler roller 176.

The inversion device 130 includes an input configured to receive the continuous web 128 with an inked surface of the continuous web 128 facing toward the printhead assembly 124, as shown in FIG. 1. The inversion device 130 inverts the continuous web 128 such that the inked surface of the continuous web 128 faces away from the printhead assembly 124 upon exiting the inversion device 130. In particular, an output of the inversion device 130 expels the continuous web 128 with the surface opposite the inked surface facing toward the printhead assembly 124. Accordingly, the surface opposite the inked surface is positioned to receive ink from the printhead assembly 126.

Figure 5:
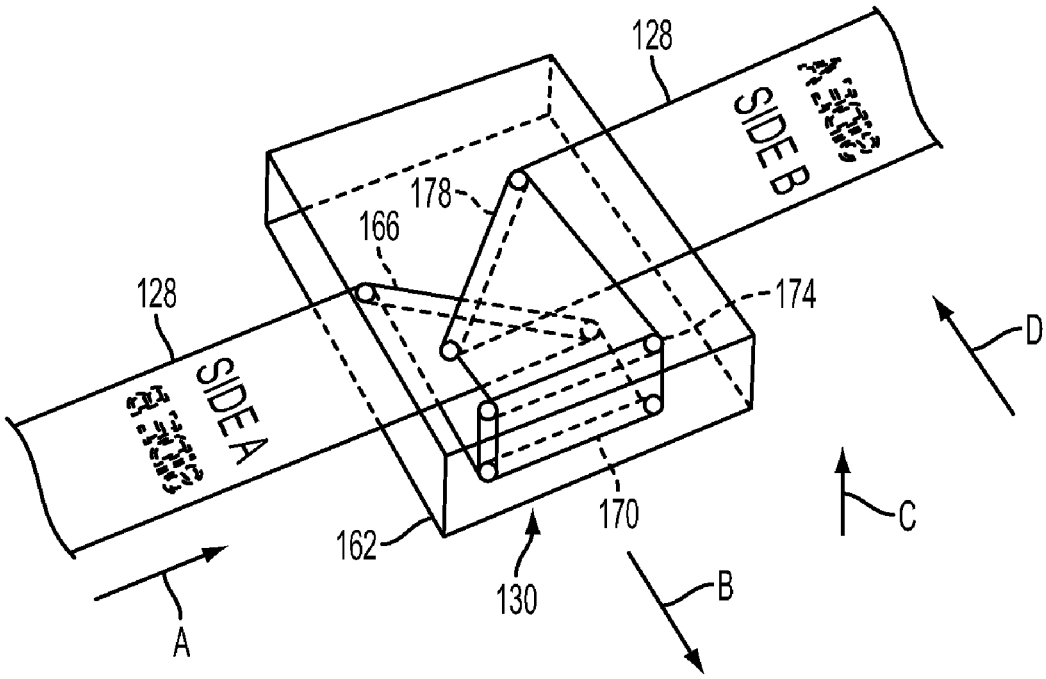
FIG. 5 is a perspective view of an inversion device configured to invert a continuous web in the printing system of FIG. 1, with rollers of the inversion device shown with phantom lines.

An exemplary inversion device 130 is shown isolated from the printing system 100 in FIG. 5. The inversion device 130 includes a support frame 162 and turn bars 166, 170, 174, 178. The frame 162 is fixedly coupled to the frame 104 of the printing system 100. In particular, the frame 162 may be connected the portion of the web path 134 extending between the roller 172 and the ink spreader 180, and the frame 162 may be connected to the portion of the web path 134 extending between the ink spreader 180 and the roller 176. The frame 162 is made from materials including, but not limited to, steel, aluminum, and high strength thermoplastics.

The turn bars 166, 170, 174, 178 of the inversion device 130 are rotatably supported by the frame 162, as shown with phantom lines in FIG. 5. The turn bar 166 is positioned to receive the continuous web 128 moving along the web path 134 in the direction A (also shown in FIG. 1). The turn bar 166 is positioned at an approximately forty five degree (45°) angle with respect to the incoming continuous web 128 to direct the web 128 in the direction B, which is approximately perpendicular to the direction A. The turn bar 170 is positioned to receive the continuous web 128 from the turn bar 166 and to direct the continuous web 128 in the direction C, which is approximately perpendicular to the directions A and B. The turn bar 174 is positioned to receive the continuous web 128 from the turn bar 170 and to direct the continuous web in the direction D, which is opposite to the direction B. The turn bar 178 is positioned at an approximately forty five degree (45°) angle with respect to the incoming continuous web 128 to direct the web 128 in the direction A. The continuous web 128 exits the inversion device 130 in an inverted orientation as compared to the orientation of the continuous web 128 as it enters the inversion device 130. In particular, a Side A of the continuous web 128 faces in the direction C when the continuous web 128 enters the inversion device 130, and an opposite Side B of the continuous web 128 faces in the direction C as the continuous web 128 exits the inversion device 130. Stated differently, the Side A of the continuous web 128 is oriented to receive ink from the second printhead assembly 126 before the inversion device 130 inverts the continuous web 128, and the Side B of the continuous web 128 is oriented to receive ink from the second printhead assembly 126 after the inversion device 130 inverts the continuous web 128.

In one embodiment, the turn bars 166, 170, 174, 178 comprise air cushion style turn bars, as are known in the art, in which air is directed through an interior cavity in the bars and through numerous holes formed through a web contact surface of the turn bars. Alternatively, the turn bars 166, 170, 174, 178 may be idler rollers that are not connected to a source of rotation. The idler roller turn bars 166, 170, 174, 178 rotate as the continuous web 128 is drawn along web path 134 by the rewinder 112 and the actuator 116.

Figure 7:
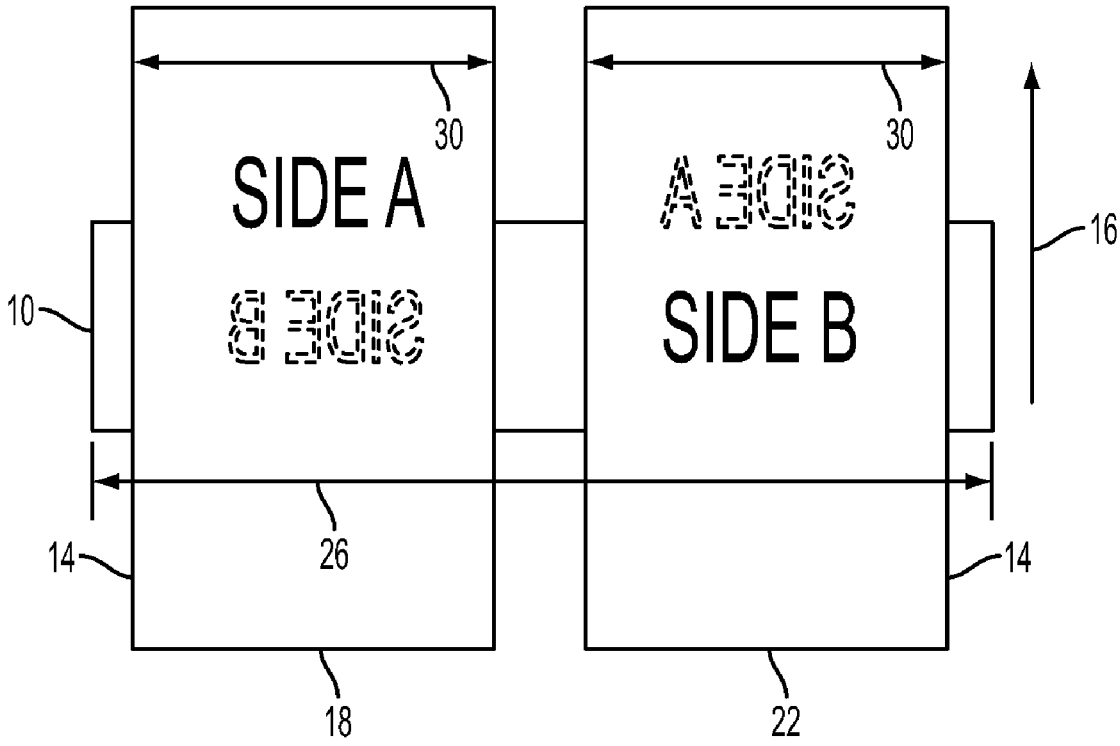
FIG. 7 PRIOR ART
FIG. 7 is a top view of an idler roller configured to guide a first portion and a second portion of a continuous web through a prior art inkjet printer, the printer being configured to perform duplex printing operations on a continuous web having a width equal to or less than half a web path width.

The inversion device 130, which may be referred to as an "inline inversion device", enables the printing system 100 to perform full-width single-pass duplex printing operations instead of being limited to only half-width dual-pass duplex printing operation. A printer configured to perform half-width dual-pass duplex printing operations is depicted in prior art FIG. 7. In particular, a top view of an idler roller 10 of the printing system is illustrated. A web path of the printing system has a width 26 approximately equal to twice a width 30 of the continuous web 14. The continuous web 14 is inverted by an inverting system separate from the printing system. After being inverted, the continuous web 14 is routed through the printing system again adjacent to a non-inverted portion of the continuous web 14. The printing system ejects ink on Side A of the non-inverted continuous web 14 and Side B of the inverted continuous web 14 at the same time. Because, two portions of the continuous web 14 pass through the printing system simultaneously, the printing system performs duplex printing operations on a continuous web having a width 30 that is less than half of the width 26 of the web path.

The printing system 100 may perform full-width single-pass duplex printing operations. To illustrate a full-width single-pass duplex printing operation, FIG. 4 depicts a top view of idler roller 172. The web path 134 has a width 222 that is approximately equal to the length of the idler rollers 172. Because the continuous web 128 makes only a single pass through the printing system 100 during duplex printing operations, the width 224 of the continuous web 128 may be approximately equal to the width 222 of the web path 134. Stated differently, the width 224 of the continuous web 128 may be approximately equal to the print width 146 of the print zone 142. In response to the printing system 100 being configured to perform a duplex printing operations, the continuous web 128 enters the printing system 100 near idler roller 168, receives ink on a first side by the printhead assembly 124, is inverted by the inversion device 130, receives ink on a second side by the printhead assembly 126 and exits the printing system 100 near ink spreader 184. Accordingly, the continuous web 128 enters and exits the printing system 100 only once during a duplex printing operation. The continuous web 128 is not routed through the printing system 100 twice to perform a duplex printing operation.

As shown in FIGS. 1 and 3, the printing system 100 includes a registration apparatus 132 configured to register the image printed by the printhead assembly 126. As used herein, the term "register" refers to positioning properly the continuous web 128 to receive ink from the printhead assembly 126. Registering an image ensures that the portion of the image formed by the printhead assembly 126 is positioned in proper relation to the portion of the image formed by the printhead assembly 124. Accordingly, among other functions, the registration apparatus 132 moves the continuous web 128 in a direction parallel to a direction of rotation of the idler roller 176. The direction of rotation of the idler roller 176 extends into and out of the page, as shown in FIG. 1. The registration apparatus 132 is electrically coupled to the controller 120, and includes a steering device 220, an imaging device 228, at least two load sensors 232, 236, and at least two encoders 240, 244. The registration apparatus 132 registers the continuous web 128 after the ink spreader 180 directs the continuous web 128 and before the idler roller 176 receives the continuous web 128.

The imaging device 228 is coupled to the frame 104 subsequent to the printhead assembly 124 and prior to the inversion device 130. The imaging device 228 detects a position of an image or ink pattern that has been ejected onto the continuous web 128 by the printing assembly 124. The imaging device 228 generates position data of the image or ink pattern and sends the position data to the controller 120. The load sensors 232, 236 send a tension signal to the controller 120 that corresponds to the tension of the continuous web 128. The encoders 240, 244 send an angular velocity signal to the controller 120. The controller 120 is configured with I/O circuitry, memory, programmed instructions, and other electronic components to process the position data, the angular velocity signal, and the tension signal to identify the position of the ejected ink pattern in the print zone between the encoders 240, 244. The controller 120 generates firing signals for the ejectors 160 in the printhead assembly 126 to control the timing of the ink droplets ejected from the one or more printhead units 136. Additionally, the position data generated by the imaging device 228 may be processed by the steering device 220, as described below, to adjust the position of the continuous web 128 in direction 248.

The imaging device 228 may be implemented with an image-on-web array ("IOWA") sensor that generates position data or image data of an ink pattern on the continuous web 128 as the continuous web 128 approaches idler roller 172. The IOWA sensor may be implemented with a plurality of optical detectors that are arranged in a single or multiple row array that extends across the entirety or at least a portion of the width 224 of the continuous web 128. The detectors generate signals having an intensity that corresponds to a light reflected off the continuous web 128. The light is generated by a light source that is incorporated in the IOWA sensor and directed toward the surface of the continuous web 128 to illuminate the surface as it passes the optical detectors. The intensity of the reflected light is dependent upon the amount of light absorbed by the ink on the continuous web 128, the light scattered by the structure of the continuous web 128, and the light reflected by the ink and continuous web 128, among other factors. The position data generated by the IOWA is sent to the controller 120.

The steering device 220 moves the continuous web 128 relative to the printhead assembly 126 and the idler roller 176 to position properly the continuous web 128 after the inversion device 130 has inverted the continuous web 128. In particular, the steering device 220 is configured to position properly the continuous web 128 upon the idler roller 176 such that the ink ejected by the printhead apparatus 126 is aligned with the ink ejected upon the continuous web 128 by the printhead apparatus 124. The steering device 220 is an electromechanical device consisting of a plurality of web rollers 252 and at least one electric motor 256. The controller 120 generates a position signal in response to processing the position data generated by the imaging device 228. The controller 120 sends the position signal to the steering device 220. In response to receiving the position signal the electric motor 256 may be activated to reposition one or more of the web rollers 252 such that the position of the continuous web 128 is adjusted with respect to the printhead assembly 126 and the idler roller 176.

The registration apparatus 132 also includes load sensors 232, 236 and encoders 240, 244 to detect the tension and the linear velocity of the continuous web 128. The load sensor 232 and the encoder 240 are positioned near the ink spreader 180. The load sensor 236 and the encoder 244 are positioned near the idler roller 176. The load sensors 232, 236 generate tension signals corresponding to a tension of the continuous web 128 near the positions of the load sensors 232, 236. The encoders 240, 244 are mechanical or electronic devices that measure the angular velocity of a rotating body. Each encoder 240, 244 generates an angular velocity signal corresponding to the angular velocity a rotating body positioned near the encoder 240, 244. In a known manner, the angular velocity signal and the tension signal are provided to the controller 120, which converts the signals to a linear velocity of the continuous web 128. The controller 120 processes the linear velocity of the continuous web 128 to determine the timing of the firing signals to send to the printhead assembly 126.

In some embodiments the printing system components positioned between the idler roller 172 and the ink spreader 180, and between the ink spreader 180 and the idler roller 176 are referred to as a media conditioner. The media conditioner receives the continuous web 128 from the ink spreader 180 and directs the continuous web 128 to the idler roller 176. The media conditioner may include the inversion device 130, the registration device 132, the ink leveling device 188, and the ink curing device 196.

Figure 6:
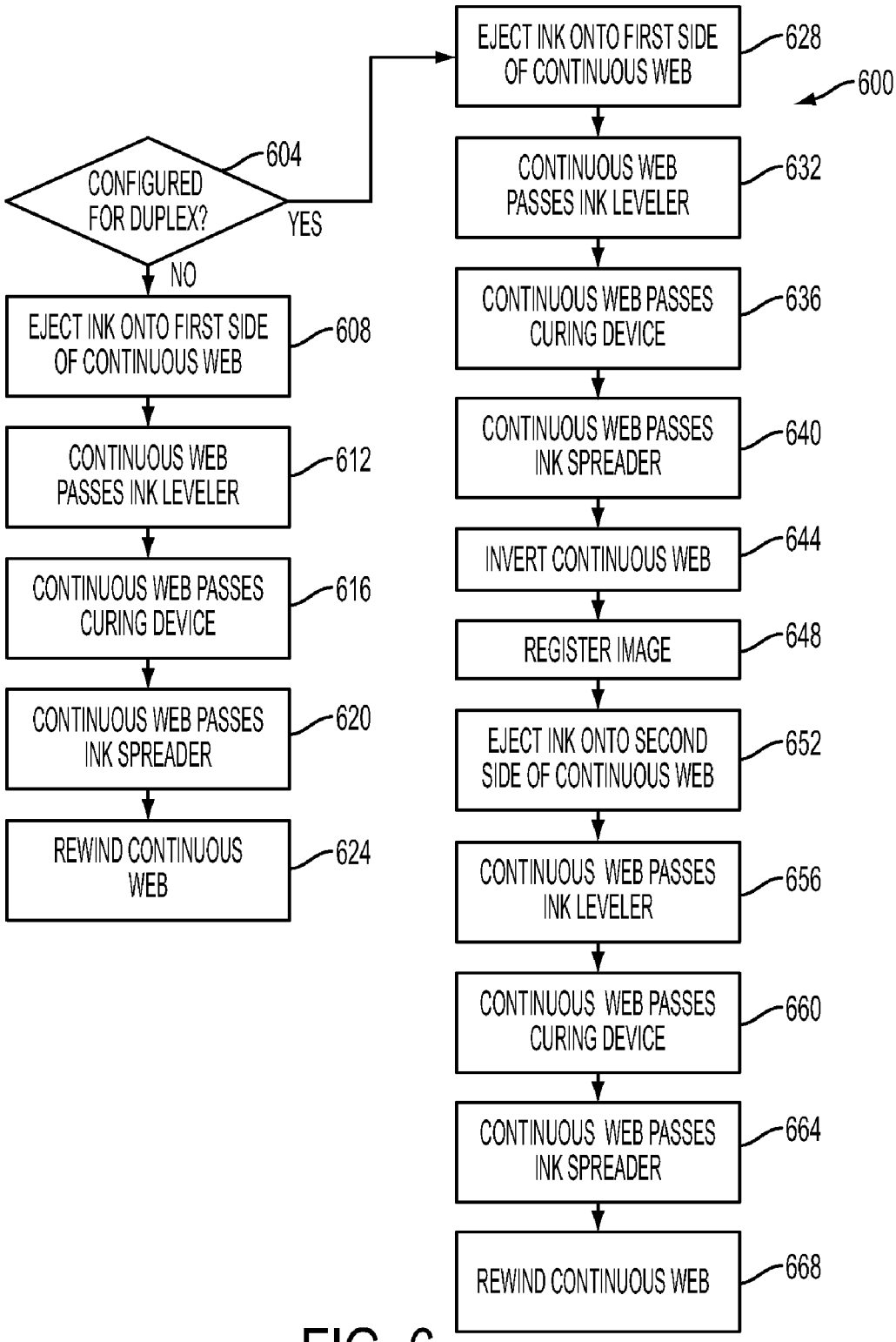
FIG. 6 is a flowchart depicting an exemplary process for operating the printing system described herein in either a simplex or a duplex configuration.

The printing system 100 may be operated according to the process 600 illustrated by FIG. 6. The printing system 100 is user configurable to perform simplex and duplex printing operations. First, the printing system 100 is configured to print either simplex or duplex images (block 604). To configure the printing system 100 to perform simplex printing operations, the continuous web 128 is routed from the web supply 108, under the idler roller 168, over the idler roller 172 and the idler roller 176, into the ink spreader 184, and to the rewinder 112. The continuous web 128 is not routed through the ink spreader 180, the inversion device 130, or the steering device 220 of the registration apparatus 132 to perform simplex printing operations. To configure the printing system 100 to perform duplex printing operations, the continuous web 128 is routed under the idler roller 168, over the idler roller 172, into the ink spreader 180, through the web inversion device 130, into the web steering device 220, over the idler roller 176, into the ink spreader 184, and to the rewinder 112. The registration apparatus 132 is activated when the printing system 100 is configured to perform duplex printing operations.

Once the continuous web 128 has been routed properly through the web path 134 and an ink composition has been supplied to the ink sources 140, the printing system 100 may begin to perform printing operations. To perform a simplex printing operation the controller 120 processes image data to generate a sequence of firing signals. After the controller 120 has generated the firing the signals, the actuator 116 is activated to draw the continuous web 128 along the web path 134 and past the printhead assemblies 124, 126. The printhead assemblies 124, 126 eject ink onto a first side of the continuous web 128 as the actuator 116 draws the continuous web 128 along the web path 134 (block 608). If the ink composition requires curing or leveling, the ink ejected onto the continuous web 128 is leveled by the leveling device 192 and cured by the curing device 200 (block 612 and block 616). If the ink composition does not require curing or leveling, the leveling device 192 and the curing device 200 remain deactivated during the printing process. Specifically, the controller 120 does not send a signal to the leveling device 192 and curing device 200 to cause the devices to become activated. Next, the continuous web 128 passes through the ink spreader 184 (block 620). If the ink composition is a spreadable ink, such as solid ink, the ink spreader 184 spreads the ink into a substantially continuous area, otherwise the ink spreader 184 does not change the appearance of the ink. To complete a simplex printing operation, the continuous web 128 is received by the rewinder 112 for further processing (block 624).

To perform a duplex printing operation the controller 120 processes image data to generate a sequence of firing signals. After the controller 120 has generated the firing the signals, the actuator 116 is activated to draw the continuous web 128 past the printhead assembly 124. The printhead assembly 124 ejects ink onto a first side of the continuous web 128 (block 628). If the ink composition requires curing or leveling, the ink ejected onto the continuous web 128 is leveled by the leveling device 188 and cured by the curing device 196 (block 632 and block 636). Next, the continuous web 128 passes through the ink spreader 180 (block 640). If the ink composition is a spreadable ink, such as solid ink, the ink spreader 180 spreads the ink into a substantially continuous area, otherwise the ink spreader 180 does not change the appearance of the ink. Thereafter, the inversion device 130 receives continuous web 128 and inverts the continuous web 128 such that a second side of the continuous web 128 is positioned to receive ink from the printhead assembly 126 (block 644). After being inverted, the continuous web 128 is registered by the registration apparatus 132 (block 648). Specifically, the continuous web 128 is received by the steering device 220, which positions the continuous web 128 in response to the signal generated by the registration apparatus 132. Next, the printhead assembly 126 ejects ink onto the second side of the continuous web 128 (block 652). If the ink ejected by the printhead assembly 126 requires curing or leveling, the ink may be leveled by leveling device 192 and cured by the curing device 200 (block 656 and block 660). Next, the continuous web 128 passes through the ink spreader 184 (block 664). If the ink composition is a spreadable ink, such as solid ink, the ink spreader 184 spreads the ink into a substantially continuous area, otherwise the ink spreader 184 does not change the appearance of the ink. Thereafter, the continuous web 128 is received by the rewinder 112 for further processing (block 668).

Those skilled in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing system comprising:

an entrance roller mounted to a frame, the entrance roller being configured to receive a print media and to direct the print media in a first direction or a second direction;

an intermediate roller mounted to the frame, the intermediate roller being configured to receive the print media after the entrance roller directs the print media in the first direction, and the intermediate roller being further configured to direct the print media in a third direction, the third direction being substantially opposite to the first direction;

an exit roller mounted to the frame, the exit roller being configured to receive the print media after one of (i) the intermediate roller directs the print media in the third direction and (ii) the entrance roller directs the print media in the second direction; and an inverter apparatus mounted to the frame, the inverter apparatus being positioned to invert the print media after the entrance roller directs the print media in the first direction and before the exit roller receives the print media, the inverter apparatus including an input configured to receive the print media with a first surface of the print media facing toward a fourth direction and an output configured to expel the print media with the first surface facing toward a fifth direction, the fifth direction being substantially opposite to the fourth direction.

2. The printing system of claim 1, further comprising:

a guide roller mounted to the frame, the guide roller being configured to receive the print media and to direct the print media in a direction substantially parallel to the third direction, and the entrance roller being further configured to receive the print media after the guide roller directs the print media in the direction substantially parallel to the third direction.

3. The printing system of claim 2, further comprising:

a printhead assembly mounted to the frame, the printhead assembly being positioned to eject ink onto the print media after the guide roller directs the print media in the direction substantially parallel to the third direction and before the print media is received by the entrance roller.

4. The printing system of claim 1, further comprising:

a guide roller mounted to the frame, the guide roller being configured to receive the print media after the exit roller directs the print media in a direction substantially parallel to the first direction.

5. The printing system of claim 4, further comprising:

a printhead assembly mounted to the frame, the printhead assembly being positioned to eject ink onto the print media after the exit roller directs the print media in the direction substantially parallel to the first direction and before the print media is received by the guide roller.

6. The printing system of claim 5, the guide roller being an ink spreading device, the ink spreading device being configured to spread the ink ejected onto the print media by the printhead assembly.

7. The printing system of claim 1, further comprising:

a printhead assembly mounted to the frame, the printhead assembly being positioned to eject ink onto the first surface of the print media before the print media is received by the entrance roller.

8. The printing system of claim 7, the intermediate roller being an ink spreading device, the ink spreading device being configured to spread the ink ejected onto the print media by the printhead assembly.

9. The printing system of claim 7, the entrance roller being configured to contact a second surface of the print media, the second surface being opposite to the first surface.

10. The printing system of claim 7, further comprising:

an ink curing device mounted to the frame, the ink curing device being configured to cure the ink ejected onto the print media by the printhead assembly after the entrance roller directs the print media in the first direction, and before the first surface contacts the intermediate roller in response to the print media being received by the intermediate roller.

11. The printing system of claim 7, further comprising:

a leveling device mounted to the frame, the leveling device being positioned to level the ink ejected onto the first surface of the print media by the printhead assembly and before the first surface contacts the intermediate roller in response to the print media being received by the intermediate roller.

12. The printing system of claim 11, wherein the leveling device is an infrared leveling device configured to expose the ink to infrared radiation.

13. The printing system of claim 1, further comprising:

a registration apparatus mounted to the frame, the registration apparatus being configured to move the continuous web in a direction parallel to an axis of rotation of the exit roller after intermediate roller directs the print media in the third direction and before the print media is received by the exit roller.

14. The printing system of claim 13, further comprising a printhead assembly mounted to the frame, the printhead assembly being positioned to eject ink onto the first surface of the print media before the print media is received by the entrance roller, and the registration apparatus further comprising (i) an imaging device mounted to the frame at a position that enables the imaging device to obtain an image of the ink ejected onto the print media, (ii) a controller electrically coupled to the imaging device to receive from the imaging device electronic data representative of the image, the controller being configured to process the data and to generate a position signal, (iii) a web steering device mounted to the frame, the web steering apparatus being configured to move print media in response to the position signal.

15. A method of printing on a print media comprising:

receiving a print media with an entrance roller, the entrance roller being mounted to a frame;

directing the print media in a first direction or a second direction with the entrance roller;

receiving the print media with an intermediate roller after the entrance roller directs the print media in the first direction, the intermediate roller being mounted to the frame;

directing the print media in a third direction with the intermediate roller after the intermediate roller receives the print media, the third direction being substantially opposite to the first direction;

receiving the print media with an inverter apparatus mounted to the frame after the intermediate roller directs the print media in the third direction, the inverter apparatus including an input configured to receive the print media with a surface of the print media facing toward a fourth direction and an output configured to expel the print media with the surface facing toward a fifth direction, the fifth direction being substantially opposite to the fourth direction;

receiving the print media with an exit roller after the inverter apparatus expels the print media, the exit roller being mounted to the frame; and receiving the print media with the exit roller after the entrance roller directs the print media in the second direction.

16. The method of printing on a print media of claim 15, further comprising:

ejecting ink onto the print media before the print media is received by the entrance roller with a printhead assembly, the printhead assembly being mounted to the frame; and curing the ink ejected onto the print media with a curing device after the entrance roller directs the print media in the first direction and before the intermediate roller receives the print media, the curing device being mounted to the frame.

* * * * *